US008561269B2

(12) United States Patent
LeCompte et al.

(10) Patent No.: US 8,561,269 B2
(45) Date of Patent: Oct. 22, 2013

(54) FASTENER HAVING A FLEXIBLE BASE

(75) Inventors: Chuck G. LeCompte, North Frankfort, KY (US); Chad A. Clark, Lawrenceburg, KY (US); Rodney H. Helwig, Lexington, KY (US)

(73) Assignee: YKK Corporation (JP)

( * ) Notice: Subject to any disclaimer, the term of this patent is extended or adjusted under 35 U.S.C. 154(b) by 0 days.

(21) Appl. No.: 12/884,554

(22) Filed: Sep. 17, 2010

(65) Prior Publication Data

US 2012/0066874 A1 Mar. 22, 2012

(51) Int. Cl.
*A44B 17/00* (2006.01)

(52) U.S. Cl.
USPC ..... 24/662; 24/108; 24/304; 24/674

(58) Field of Classification Search
USPC ..... 24/662, 304, 664, 668, 693, 674, 108, 24/303, 662.693, 306, 464, 575.1, 586.11, 24/594.11, 598.1, 623, 689, 691; 2/422
See application file for complete search history.

(56) References Cited

U.S. PATENT DOCUMENTS

| | | | | | |
|---|---|---|---|---|---|
| 1,451,612 | A | * | 4/1923 | Hausner | 229/125.23 |
| 1,904,122 | A | * | 4/1933 | Chapman | 24/575.1 |
| 2,648,614 | A | * | 8/1953 | Martin et al. | 428/352 |
| 2,683,908 | A | * | 7/1954 | Carpinella | 24/108 |
| 2,745,159 | A | | 5/1956 | Jones | |
| 3,010,169 | A | * | 11/1961 | Carpinella | 24/107 |
| 3,107,409 | A | | 10/1963 | Arthaud et al. | |
| 3,243,858 | A | | 4/1966 | Melanson | |
| 3,466,714 | A | * | 9/1969 | Nysten | 24/689 |
| 3,750,938 | A | * | 8/1973 | Wiseman | 229/77 |
| 3,769,664 | A | * | 11/1973 | Parera | 24/689 |
| 3,882,853 | A | | 5/1975 | Gofman | |
| 3,918,140 | A | * | 11/1975 | Konstant | 29/271 |
| 3,965,952 | A | * | 6/1976 | Rivman et al. | 383/86 |
| 4,698,881 | A | * | 10/1987 | Watanabe | 24/113 MP |
| 4,719,674 | A | * | 1/1988 | Kit | 24/586.11 |

(Continued)

FOREIGN PATENT DOCUMENTS

| | | | |
|---|---|---|---|
| FR | 2218851 | A1 | 9/1974 |
| FR | 2747276 | A1 | 10/1997 |
| JP | 3084543 | | 3/2002 |
| JP | 51-90644 | | 4/2010 |

OTHER PUBLICATIONS

"GoFia.com—Step 1" http://www.gofia.com/index.cfm?pageID=14&productSeries=2&model=&year=&step=1 downloaded from the Internet on Sep. 2, 2010.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

Fasteners including male and female assemblies. At least one of the male or female assembly may have a flexible base that flexes to conform to a non-planar mounting surface. The flexible base is bonded to the stud and/or the socket using techniques that provide a high degree of strength to withstand repeated engagement and disengagement of the fastener. Moreover, in certain embodiments the bonding techniques eliminate the need for mechanical means (for example, threads) to secure the stud to the flexible base. Mechanical tests show that the male assembly according to certain embodiments has 62% more strength than known male assemblies.

12 Claims, 10 Drawing Sheets

(56) References Cited

U.S. PATENT DOCUMENTS

| | | | | | |
|---|---|---|---|---|---|
| 4,805,272 | A | * | 2/1989 | Yamaguchi | 24/623 |
| 5,003,673 | A | * | 4/1991 | Nysten | 24/662 |
| 5,014,400 | A | * | 5/1991 | Ban | 24/108 |
| 5,075,938 | A | * | 12/1991 | Hutchinson | 24/464 |
| 5,113,553 | A | * | 5/1992 | Hutchinson | 24/464 |
| 5,212,851 | A | * | 5/1993 | Wantanabe | 24/108 |
| 5,375,302 | A | | 12/1994 | Takamura | |
| 5,797,643 | A | * | 8/1998 | Demedash | 296/100.16 |
| 5,956,816 | A | | 9/1999 | McCrink | |
| 6,718,559 | B1 | * | 4/2004 | Davidson | 2/422 |
| 8,061,898 | B2 | * | 11/2011 | Pawloski et al. | 383/59 |
| 2004/0244161 | A1 | * | 12/2004 | Jung | 24/598.1 |
| 2009/0293239 | A1 | | 12/2009 | Stumpfl | |

OTHER PUBLICATIONS

European Search Report, European Patent Application No. 11007538.9, mailed Dec. 21, 2011.

International Search Report and Written Opinion, PCT Application No. PCT/US11/51674, mailed Nov. 2, 2011.

* cited by examiner 40
60
46
54
50
42
52
66
62
44
48

50
60
46
42

40
42
54
60
46
66

40
62
66
60
42
46

FASTENER HAVING A FLEXIBLE BASE

FIELD OF THE INVENTION

The invention relates generally to fasteners that may be secured to mounting surfaces, and in particular, fasteners comprising a flexible base that may be secured to non-planar surfaces and that offer increased strength over known fasteners.

BACKGROUND OF THE INVENTION

In a variety of applications, it may be desirable to provide a fastener that can secure a first and second object together. Examples of objects may include a surface of a boat (such as the hull), a vehicle (such as the grill, hood, or cargo area of an automobile), or a hot tub or pool located on a deck or patio. Other examples may include fabric covers, tarps, straps, or bars. Thus, it may be desirable to provide a fastener to secure a cover to the grill of a vehicle, a tarp to the bed of a pick-up truck, or a cover to the hull of a boat.

Such fasteners typically comprise a socket and a stud. The socket may include a base portion and a receiving portion protruding from the base. Likewise, the stud may include a base and a protrusion extending from the base. The receiving portion of the socket receives the protrusion of the stud, thus engaging the stud and the socket, preventing separation of the fastener. The socket may be secured to a mounting surface of a first object, and the stud may be secured to a mounting surface of the second object. As used herein, "mounting surface" refers to a surface of the object where the fastener is secured to the object. Thus, the socket may be coupled to the grill of a vehicle, and the stud may be coupled to the fabric cover. It should be understood that the fastener may be reversed, such that the stud is coupled to the grill and the socket is coupled to the fabric cover. For ease of reference, the background section of this disclosure refers to the stud and socket interchangeably as "a fastener component" unless otherwise noted.

One technique for coupling the fastener component to the mounting surface involves drilling a hole in the mounting surface and using a screw to clamp the fastener component to the mounting surface. But this technique has a significant disadvantage of damaging the mounting surface by drilling a hole through the surface. Thus, alternative techniques have been developed to avoid damaging the mounting surface.

One such alternative technique uses adhesives to secure the fastener component to the mounting surface. For example, the base of the fastener component (which typically has a planar surface) may be coated with a layer of adhesive and then secured to the mounting surface. It may be difficult to provide a strong bond if the mounting surface is curved or otherwise non-planar. Specifically, when coupled, there may be a gap between the planar base of the fastener component and the non-planar mounting surface. The gaps reduce the strength of the bond between the fastener component and the mounting surface. Thus, if the fastener is repeatedly engaged and disengaged over several cycles, then the fastener component may pull apart from the mounting surface. (It should be noted that the same difficulties may be encountered when welding—as opposed to adhering—the fastener component to the non-planar mounting surface.)

U.S. Pat. No. 5,797,643, which lists Lloyd Demedash as an inventor (hereinafter, "Demedash"), describes a fastener that purports to couple to non-planar mounting surfaces. Specifically, Demedash describes a "flexible mounting member" that is affixed to the fastener and that deforms to follow the curvature of a non-planar mounting surface. The flexible mounting member has a post that engages with an aperture defined in the fastener, thus securing the flexible mounting member to the fastener. Demedash teaches that the amount of force provided by the post (to secure the flexible mounting member and the fastener) is greater than the amount of force necessary to disengage the fastener (that is, to pull the socket from the stud). Thus, according to Demedash, the flexible mounting member will not detach when the fastener is repeatedly engaged and disengaged over several cycles. Demedash is assigned to FIA, Inc. of Winnipeg, Canada, which makes the STICK A STUD® product that is allegedly a commercialized embodiment of Demedash.

But the fastener described by Demedash (and the STICK A STUD® product) have several disadvantages. Most notably, tests performed on the STICK A STUD® product establish that the product fails when subjected to relatively low pull strengths. Additionally, the method of attachment between the flexible mounting member and the fastener requires specific design constraints that may be undesirable. Specifically, the post of the flexible mounting member requires that an aperture be provided in the fastener. It may not necessarily be desirable to provide a fastener with such an aperture. Finally, the post protrudes into the body of the fastener, which may obstruct proper engagement of the socket and stud.

Thus, it is desirable to provide a fastener component that couples to a non-planar mounting surface, but at the same time provides a high degree of strength prior to failure, withstands repeated engagement and disengagement of the fastener over several cycles, and also avoids limiting design constraints.

SUMMARY OF THE INVENTION

Examples described herein include a male assembly for a fastener, the male assembly comprising a rigid stud that is bonded to a flexible base. A layer of adhesive may be provided on the flexible base to thereby secure the male assembly to a mounting surface. If the mounting surface is non-planar, then the flexible base may flex to conform to the non-planar mounting surface. Techniques used to bond the stud to the flexible base provide a high degree of strength to withstand repeated engagement and disengagement of the fastener. Moreover, the bonding techniques may eliminate the need for the post as provided in Demedash to secure the stud to the flexible base.

Similarly, some examples include a female assembly comprising a rigid socket that is bonded to a flexible base that may flex to conform to a non-planar mounting surface. Bonding techniques provide a high degree of strength, and may eliminate the need for mechanical means to secure the socket to the flexible base. It is not necessary for a single fastener to include both a male assembly and a female assembly with a flexible base—only one of the assemblies may be provided with a flexible base.

Mechanical tests performed on the male assembly show an increase of 62% in strength over the fastener described by Demedash.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE INVENTION

Figure 2B:
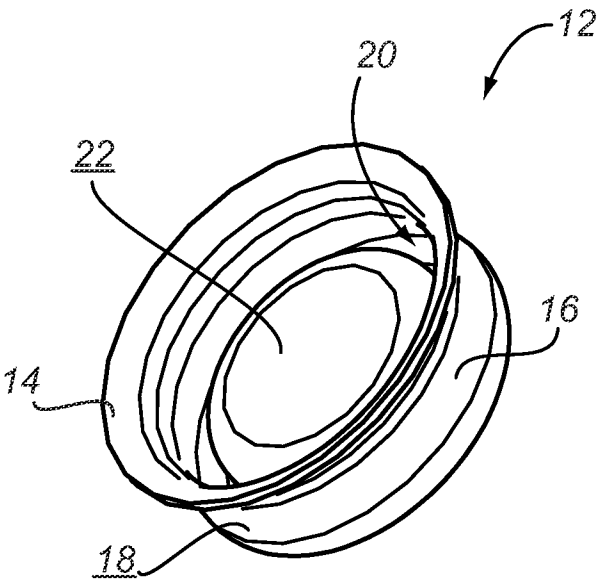
FIGS. 2A-E are various views of one embodiment of a stud according to the male assembly shown in FIGS. 1A-D.
Figure 2A:
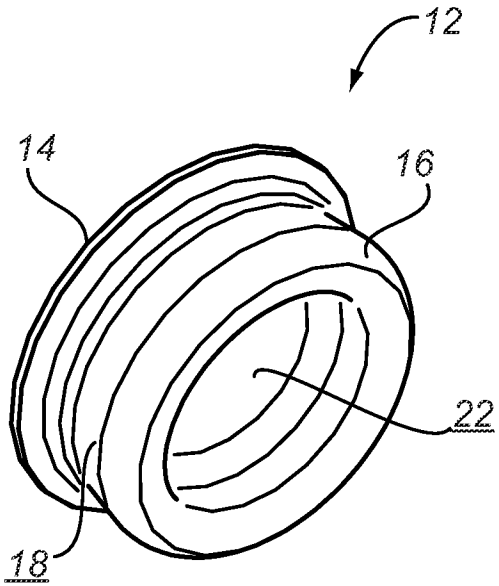
Figure 2E:
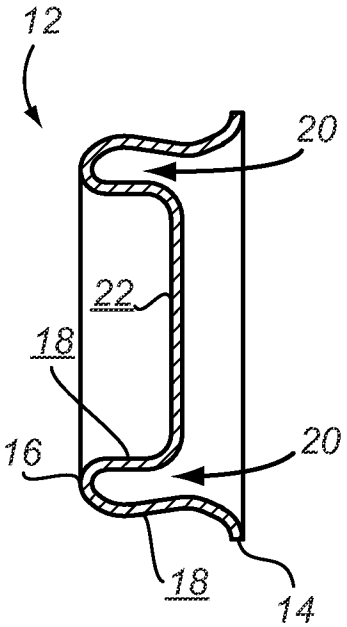
Figure 2D:
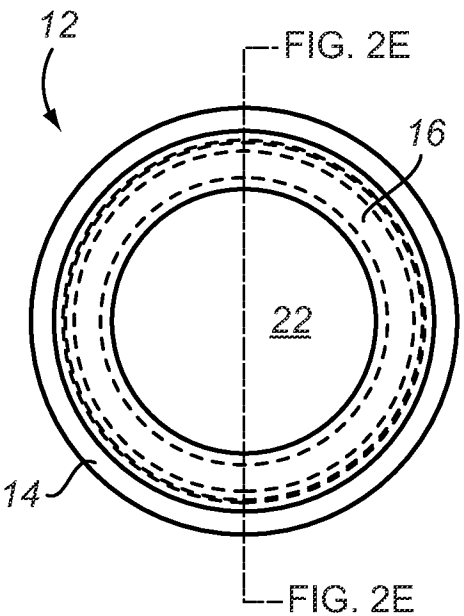
Figure 2C:
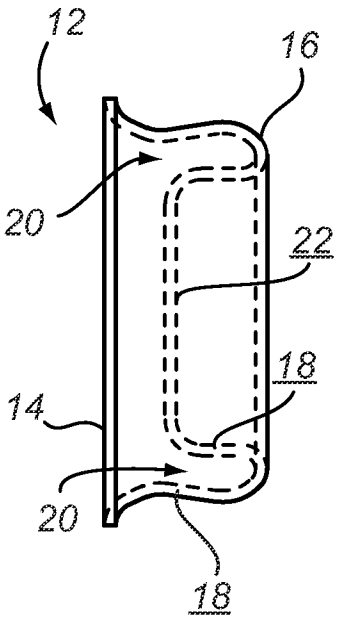
Figures 3A, 3B, 3C, 3D:
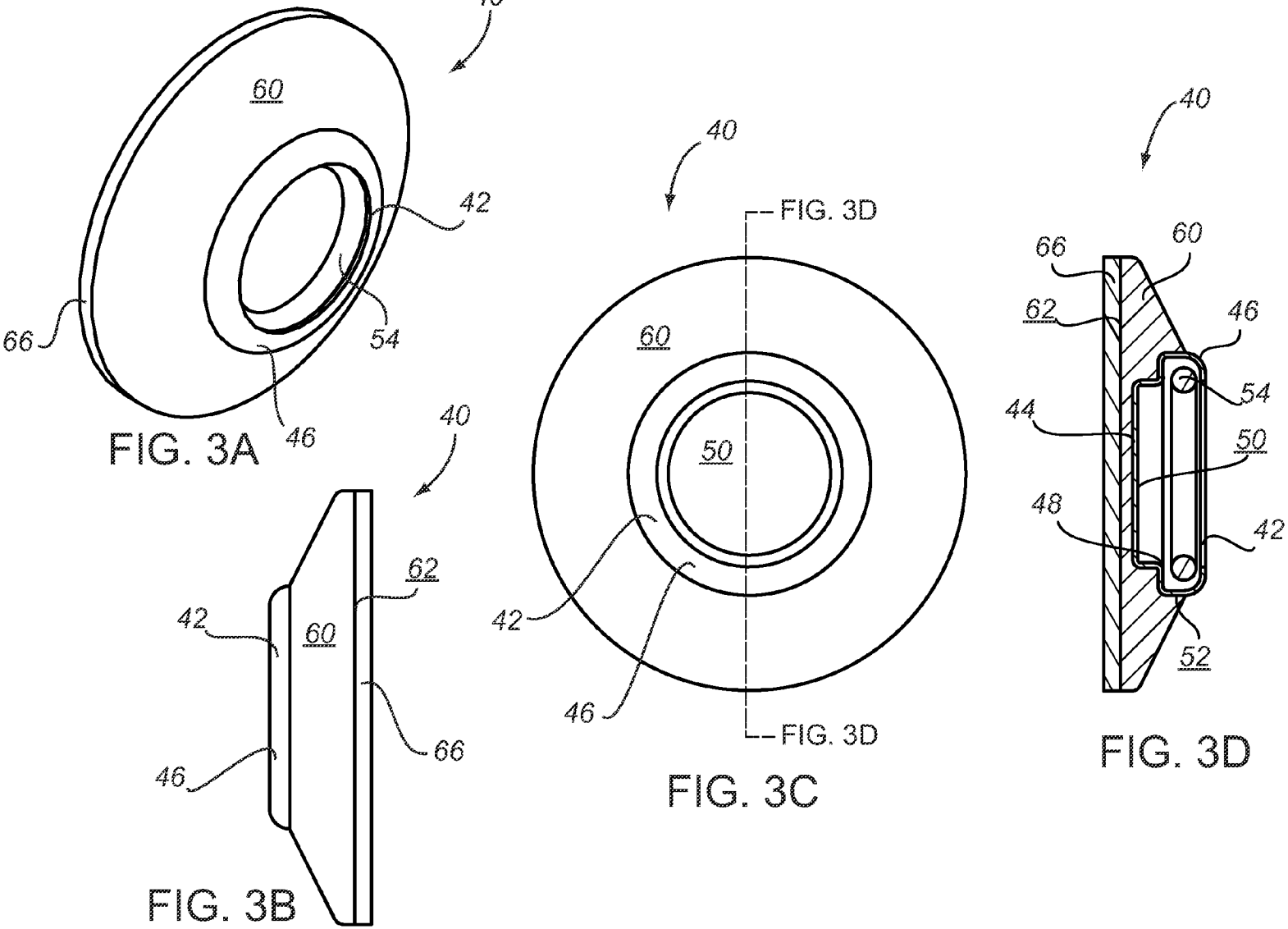
FIGS. 3A-D are various views of one embodiment of a female assembly of a fastener.
Figure 5:
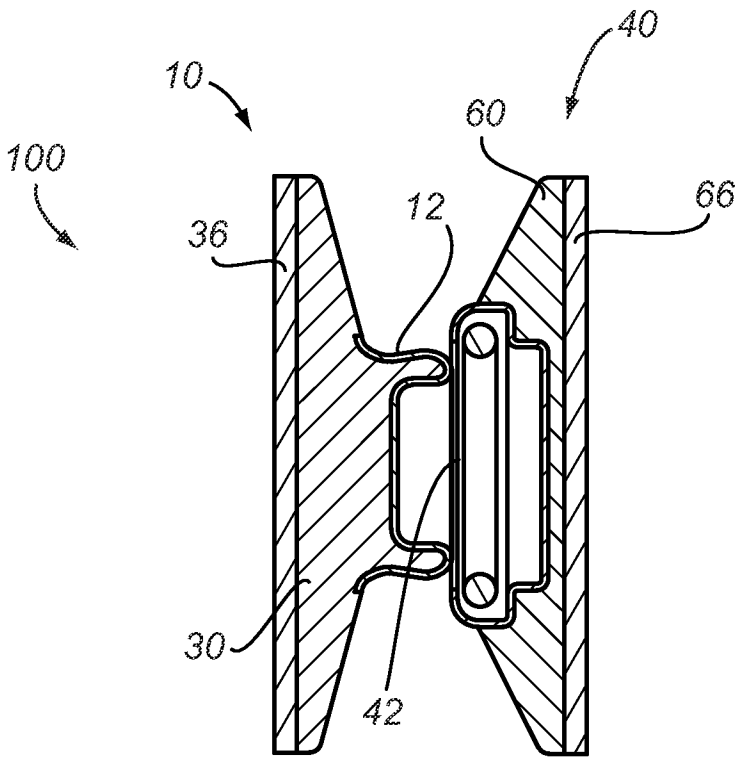
FIG. 5 is a cross-sectional view of a fastener comprising a male assembly and a female assembly according to certain embodiments.

Certain embodiments of the invention provide a male assembly 10 and a female assembly 40 that may be secured to one another in order to form a fastener 100 (as shown in FIG. 5). The male assembly 10 may include a stud 12 (as shown in FIGS. 2A-E) comprising a protrusion 16 extending from a base 14. As can be seen in FIG. 2C, the base 14 is generally planar. In the embodiments shown in the figures, the protrusion 16 is shaped like a continuous ring, but it should be understood that in other embodiments, the protrusion 16 may have other shapes, and may or may not be continuous. The protrusion 16 may be defined by a sidewall 18. As shown in the cross-sectional view of FIG. 2E, in some embodiments the sidewall 18 is generally "U-shaped" (although the sidewall 18 is not necessarily symmetrical) and defines a pocket 20 inside the U-shape, such that the protrusion 16 is "hollow." A central surface 22 is positioned in the middle of the circular-shaped protrusion 16.

Figure 4B:
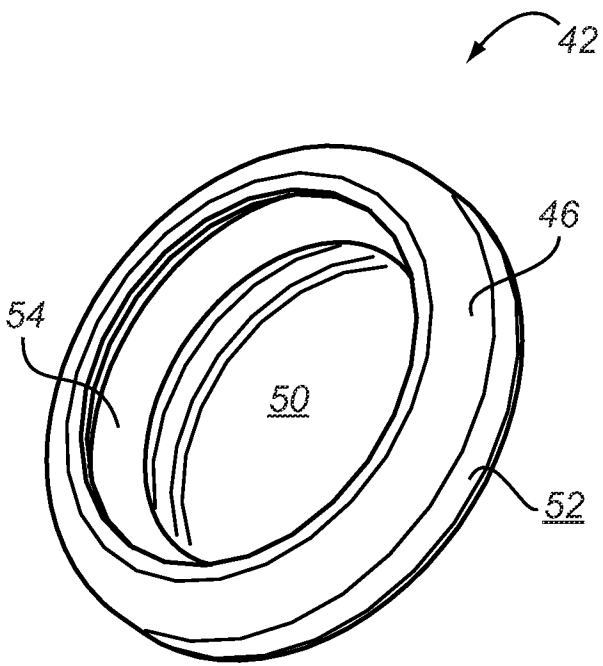
FIGS. 4A-E are various views of one embodiment of a socket according to the female assembly shown in FIGS. 3A-D.
Figure 4A:
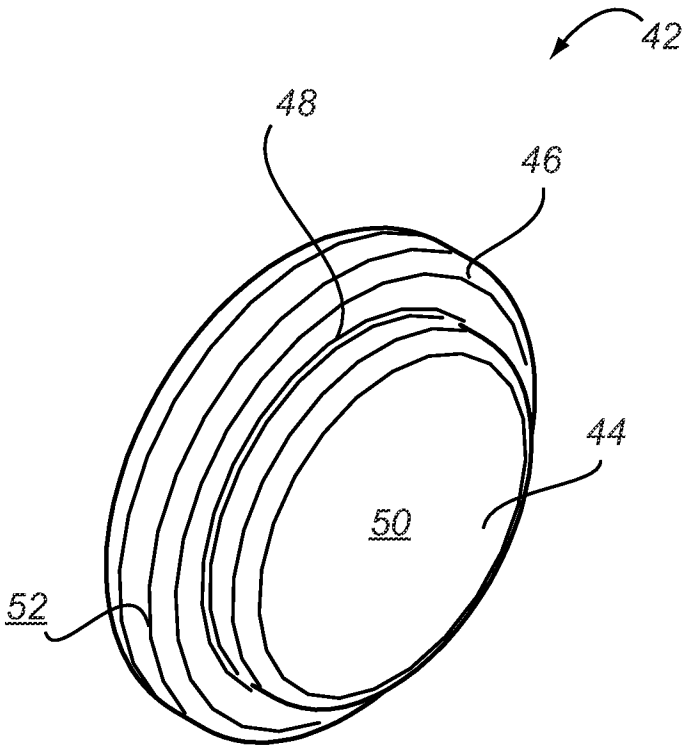
Figure 4E:
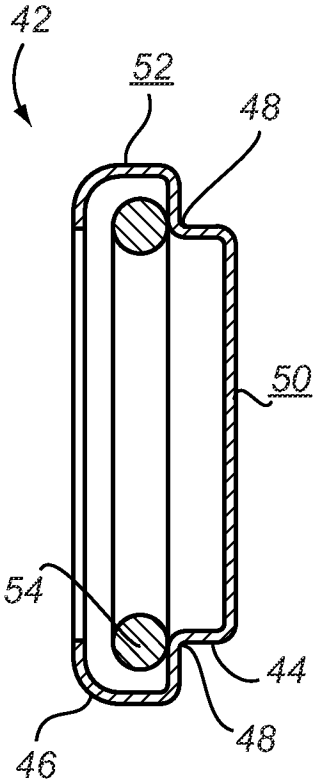
Figure 4D:
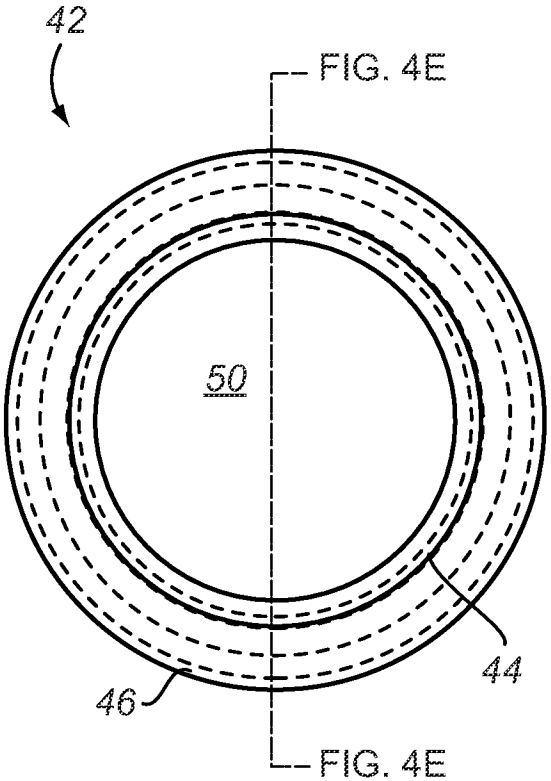
Figure 4C:
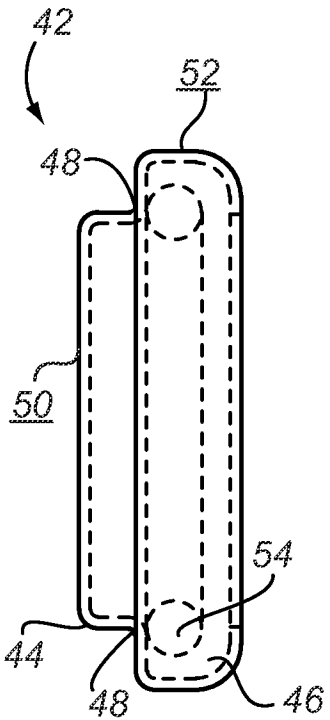

The female assembly 40 may include a socket 42 (as shown in FIGS. 4A-E) comprising a receiving portion 46 and a base portion 44. In the embodiments shown in the figures, the receiving portion 46 has a larger diameter than the base portion 44. The receiving portion 46 extends from the base portion 44 and is defined by a sidewall 52. A corner 48 is formed where the base portion 44 and the receiving portion 46 meet. In the embodiments shown in the figures, the receiving portion 46 and the base portion 44 are both circular, but it should be understood that in other embodiments, the respective portions 44, 46 may have other shapes. As can be seen in FIG. 4C, the base portion 44 has a bottom surface 50 that is generally planar.

As shown in FIG. 5, the receiving portion 46 of the socket 42 receives and secures the protrusion 16 of the stud 12 with a mechanical interference fit, thus engaging the stud 12 and the socket 42, preventing separation of the fastener 100. In certain embodiments, the receiving portion 46 comprises a retainer 54 proximate the inner surface of the sidewall 52. The retainer 54 may have a smaller diameter than the receiving portion 46, such that the retainer 54 may provide a more secure mechanical interference fit with the protrusion 16 of the stud 12. It should be understood that the retainer 54 is only optional and is not required.

The stud 12 and/or the socket 42 may be formed of a variety of materials, such as metals (including but not limited to stainless steel) or any rigid or semi-rigid plastic. If made of metal, the stud 12 and socket 42 may be stamped into their final forms. If made of plastic, the stud 12 and socket 42 may be injection die molded.

Figure 7:
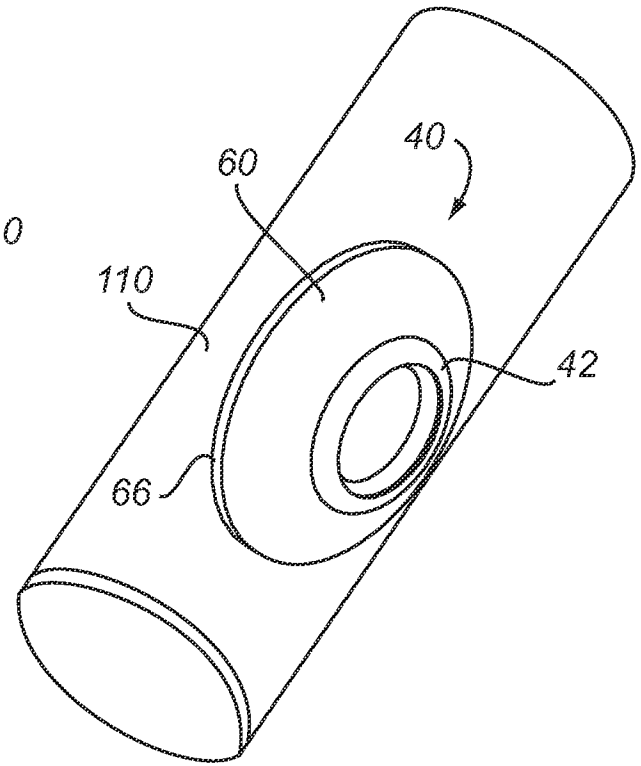
FIG. 7 illustrates a female assembly secured to a non-planar mounting surface according to certain embodiments.
Figure 6:
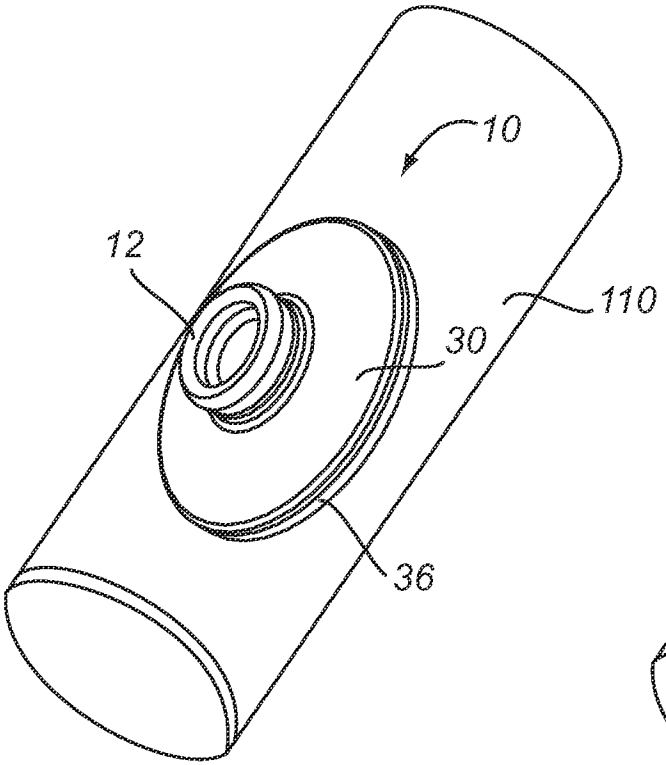
FIG. 6 illustrates a male assembly secured to a non-planar mounting surface according to certain embodiments.

In certain embodiments, the stud 12 is coupled to a flexible base 30 to form a male assembly 10 (as shown in FIGS. 1A-D). Similarly, in certain embodiments the socket 42 is coupled to a flexible base 60 to form a female assembly 40 (as shown in FIGS. 3A-D). Each flexible base 30, 60 may flex to conform to a non-planar mounting surface 110. Thus, as shown in FIG. 6, the flexible base 30 of the male assembly 10 is flexed to conform to the non-planar mounting surface 110 (here, a section of pipe). A layer of adhesive 36 on the bottom surface 32 of the flexible base 30 secures the male assembly 10 to the mounting surface 110. Similarly, in FIG. 7, the flexible base 60 of the female assembly 40 is flexed to conform to the surface 110. A layer of adhesive 66 on the bottom surface 62 of the flexible base 60 secures the female assembly 40 to the mounting surface 110. It should be understood that it is not necessary for a single fastener 100 to include both a male and female assembly 10, 40 with a flexible base 30, 60. Rather, a fastener 100 may be provided with only one assembly (either the male 10 or female 40) that includes a flexible base.

Methods of manufacturing the assemblies 10, 40 will now be described. For ease of reference, this discussion refers to the manufacture of the male assembly 10, although it should be understood that the same general methods may be used for the female assembly 40.

First, the stud 12 is pre-treated with a bonding or priming agent in order to help strengthen the bond between the stud 12 and the flexible base 30. One such bonding agent is a dilute solution of moisture-reactive materials in VM&P naphtha. The Dow-Corning Company produces such a material, under the name of Dow-Corning Prime Coat #2260. In certain embodiments the stud 12 is treated with the bonding agent for at least fifteen minutes, after which time the excess bonding agent is drained or wiped clean from the stud 12.

In general, the flexible base 30 may be made of silicone, rubber, or any flexible plastic. In one non-limiting embodiment, the flexible base 30 is made from a blend of Dow-Corning TR-70 and Q-44768 elastomer materials, with their specific ratios being adjustable depending upon the specific application. If desired, a catalyst may be used to form the flexible base 30. One possible catalyst is an organic peroxide, which may be provided in different forms depending upon whether the flexible base 30 is clear or tinted. For a clear flexible base 30, the catalyst may be an organic 100% peroxide in liquid form, having the chemical composition 2,5 dimethyl-2,5 di/t-butylperoxy/hexane. For a tinted flexible base 30, the above catalyst may be provided in only a 50% peroxide powder form. Either of the above catalysts may be supplied by Dow-Corning Company, as DBPH-100 for clear elastomers, or as DBPH-50 for colored or tinted elastomers. Alternative catalytic agents include platinum and tin compounds. When the catalyzing process has been completed, the material that comprises the flexible base 30 will be in the form of a resilient solid. In certain embodiments, the material is formed in sheets. If desired, multiple layers or thicknesses may be used to create the male assembly 10.

Figure 1A:
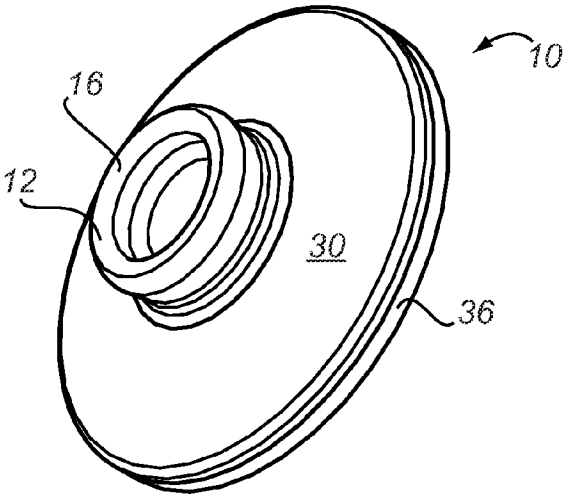
FIGS. 1A-D are various views of one embodiment of a male assembly of a fastener.
Figure 1B:
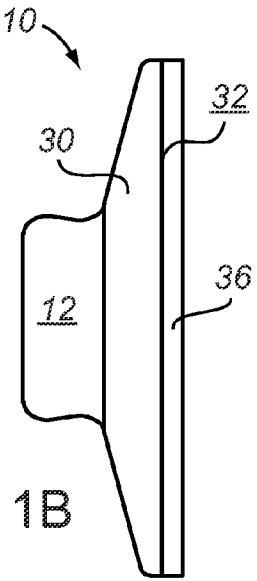
Figure 1C:
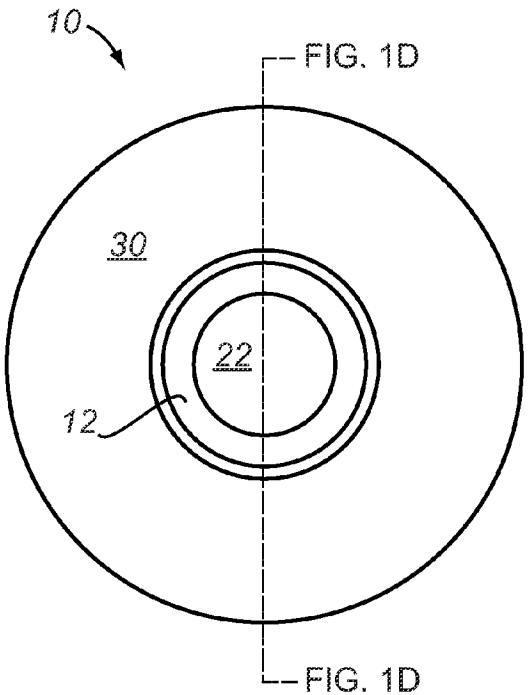
Figure 1D:
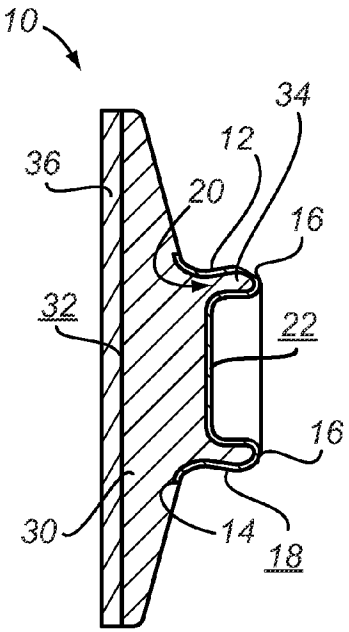

Next, the material that comprises the flexible base 30 may be bonded to the stud 12. In one embodiment, a suitable container or holder (similar to a mold) may be provided to assist in the bonding process. If desired, the mold may have a "stud portion" to receive the stud 12, and a "base portion" that is shaped to form the flexible base 30. The base portion may have a profile that forms a flexible base 30 with a particular shape or size. For example, as shown in FIG. 1D, the top surface of the flexible base 30 is angled relative to the stud 12. Thus, the base portion of the mold may have a profile to produce this particular angle. In other embodiments, the flexible base 30 may have a different angle, may not be angled, or may be dome-shaped, etc. The mold may produce a flexible base 30 having any desired shape or size.

The stud 12 may be placed inside of the stud portion of the mold, with the base 14 of the stud 12 facing the base portion of the mold. The material that comprises the flexible base 30 may be placed directly on top of the base 14 of the stud 12, within the base portion of the mold. Next, a heated plate or the like may be placed atop the material that comprises the flexible base 30, and pressure may be applied to the plate to press the material onto the stud 12. In certain embodiments, the curing temperature is approximately 340° F., and the plate is left in place for approximately two minutes. The heat and pressure process causes the material that comprises the flexible base 30 to melt. The melted material flows within the base portion of the mold, forming the particular shape of the flexible base 30. If the stud 12 is provided with pockets 20, then the melted material may flow into the pockets 20, forming extensions 34 to fill the pocket 20. The heat and pressure thus bond the flexible base 30 to the stud 12, forming the male assembly 10. Next, the plate may be removed from the male assembly 10 and excess material that comprises the flexible base 30 may be trimmed.

Due to the bonding of the flexible base 30 and the stud 12, it is not necessary to provide a post in the flexible base 30 as described by Demedash. All of the bonding is accomplished by the application of heat and pressure, and if desired, pre-treating of the stud 12 with a bonding agent. Increased bonding strength (in particular, increased shear strength) may also be provided in embodiments having extensions 34 that fit within pockets 20.

A layer of adhesive 36 may be affixed to the bottom surface 32 of the flexible base 30 to thereby secure the male assembly 10 to the mounting surface 110. The adhesive may comprise either a non-reactive adhesive or a reactive adhesive. The type of adhesive to be used may be determined by the size of the substrate and/or the mounting surface 110. One of skill in the art would be aware of many suitable adhesives, but one non-limiting example is the VHB® Tape, sold by 3M Company, which is made with a layer of acrylic foam and a layer of adhesive. The VHB® Tape is offered with several adhesive types, including multi-purpose acrylic (that bonds to metals, glass, and high and medium surface energy plastics and paints), modified acrylic (that bonds to low surface energy plastics and paints, such as powder-coated paints), or low temperature appliable acrylic (that bonds down to 32° F.). The VHB® Tape is also offered with several foam types, each having different levels of conformability. If desired, the bottom surface 32 of the flexible base 30 may be pre-treated with a bonding agent, or may be mechanically deformed (such as with a sander) prior to application of the adhesive 36. The adhesive 36 may simply be pressed onto the bottom surface 32 of the flexible base 30 under atmospheric temperature and pressure. That is, no heated platen and/or extreme pressures are needed to bond adhesive 36 to the flexible base 30. Similarly, no heated platen and/or extreme pressures are needed to bond the adhesive 36 to the mounting surface 110. (If desired, adhesive may also be applied directly to the mounting surface 110.)

Although the preceding discussion of the methods of manufacture referred to the male assembly 10, it should be understood that the same methods may be used for the female assembly 40. In the embodiments shown in FIG. 3, the socket 42 is provided with a corner 48 where the base portion 44 and the receiving portion 46 meet. When the material that comprises the flexible base 60 melts due to the application of heat and pressure, the material flows around the base portion 44, into the corner 48, and around at least a portion of the receiving portion 46. The amount of surface area between the flexible base 60 and the socket 42 (specifically, around the base portion 44, the corner 48, and at least a portion of the receiving portion 46) provides increased shear strength for the female assembly 40.

When the fastener 100 is secured to the mounting surface 110 and put into use, there are three possible points of "failure" of the fastener—specifically, between (1) the adhesive 36 and the mounting surface 110; (2) the adhesive 36 and the bottom surface 32 of the flexible base 30; and (3) the stud 12 and the flexible base 30. The term "point of failure" means that the components separate or break apart at that point. For example, if the fastener 100 failed between the adhesive 36 and the mounting surface 110, it means that the adhesive 36 pulled or ripped away from the mounting surface 110. In the optimal design of a fastener, the force that will cause a failure is significantly greater than the force of engaging and disengaging the fastener 100. In other words, it is desired that the fastener will not fail when it is engaged and disengaged, and in particular, that the fastener will not fail over repeated cycles. It has been found that embodiments of fasteners 100 described herein provide increased strength at each of these points of failure.

Figure 8:
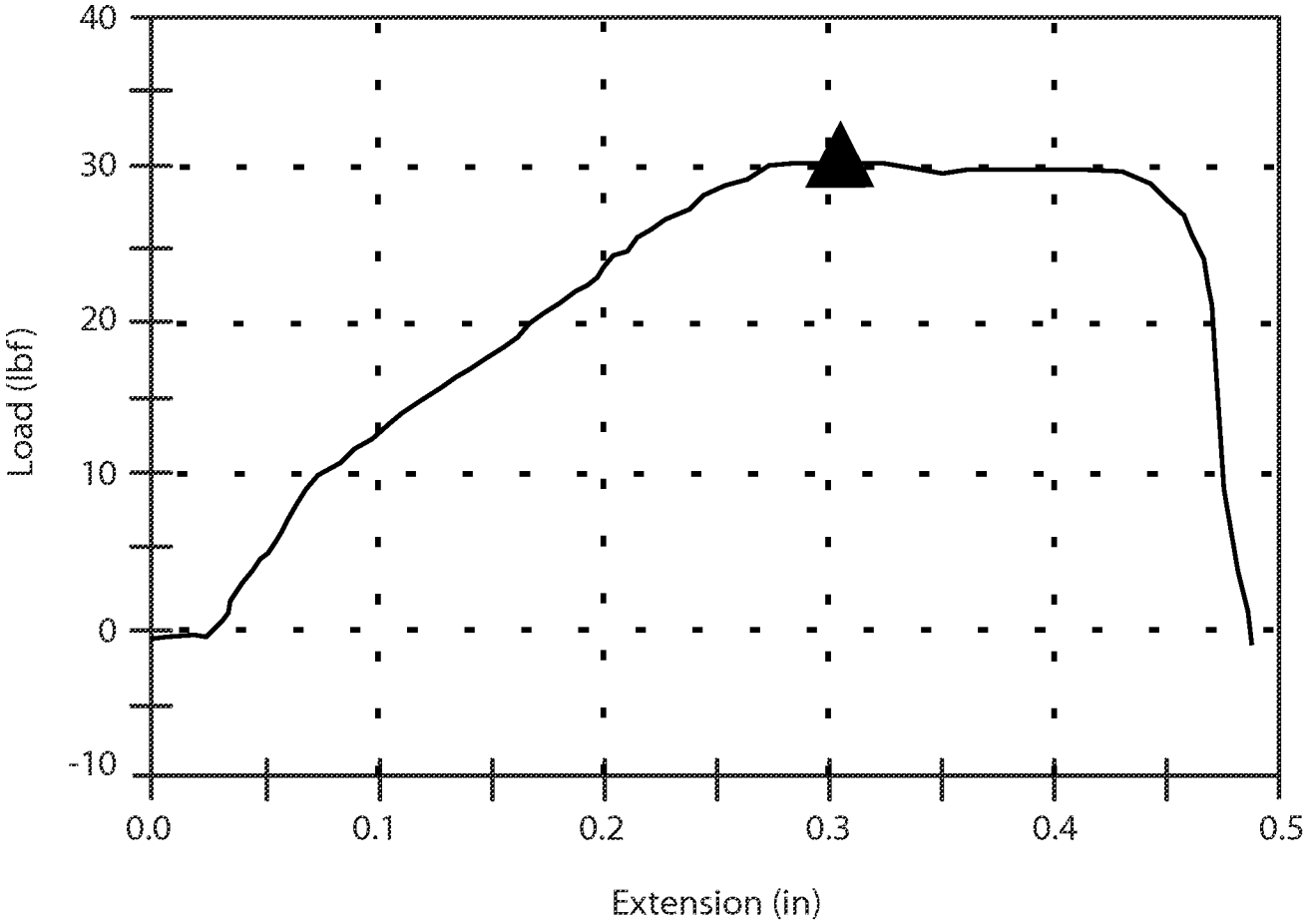
FIG. 8 is a graph showing test results performed on a male assembly according to certain embodiments.
Figure 9:
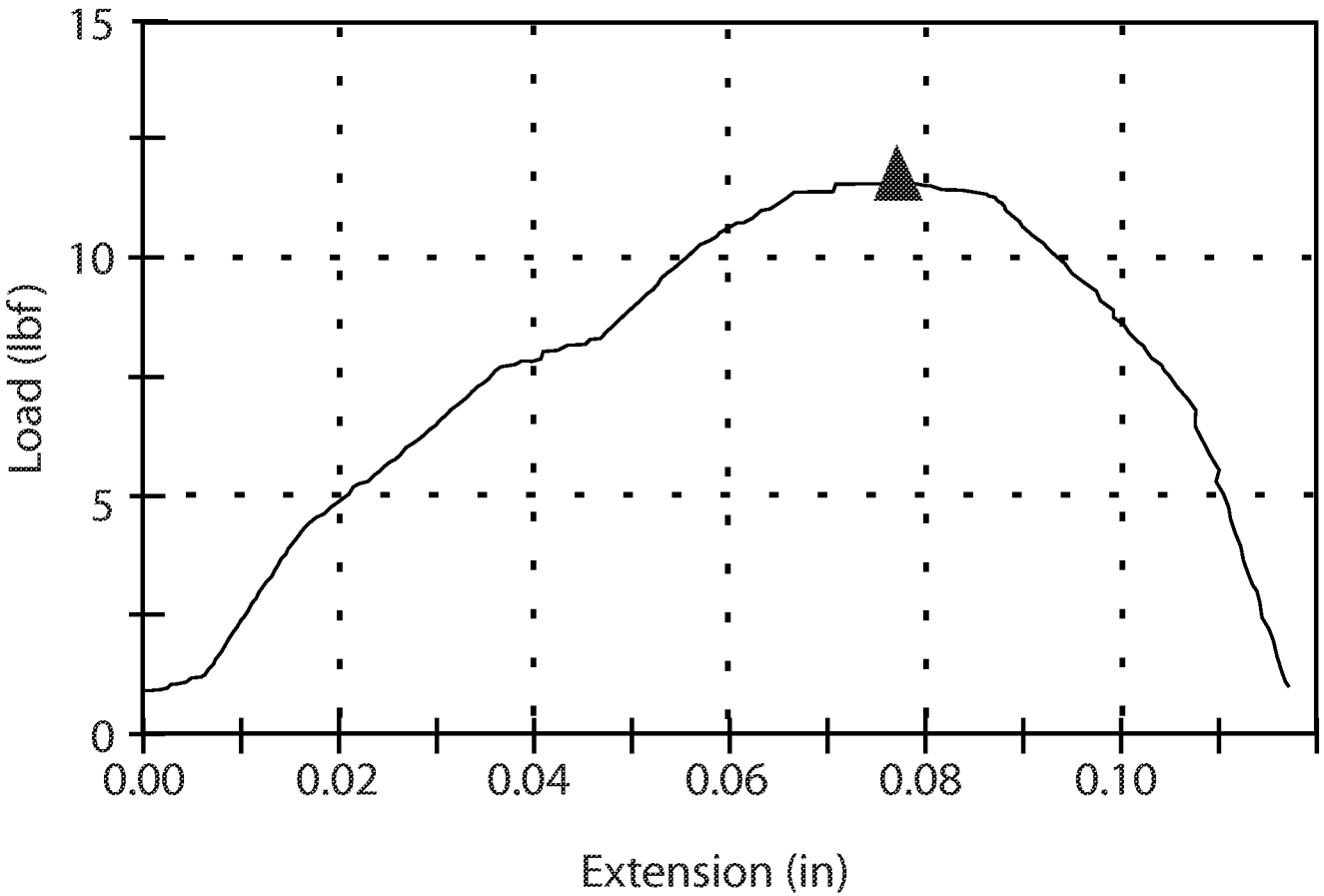
FIG. 9 is a graph showing test results performed on a product as described by Demedash.

Specifically, the STICK A STUD® product (which is allegedly a commercialized embodiment of Demedash) and a product according to certain embodiments described herein (the "applicant's product") were compared in strength tests. In one test, an Instron Model 4444 force gauge ("Instron") was used in a direct pull strength test of both the STICK A STUD® product and the applicant's product. The testing configuration for both products was the same. First, the male assembly of the fastener (the female assembly component was not tested) was secured to a rod. Then the upper clap fixture of the Instron was used to clamp the stud of the assembly. Each assembly was pulled by the Instron over known distances, as reflected in FIG. 8 (pull strength test results of the applicant's product) and FIG. 9 (results of the STICK A STUD® product). The black triangles on each Figure indicates the point that the respective product failed. As shown in FIG. 8, the applicant's product was pulled a distance of approximately 0.3 inches before it failed at a load of 30.8 pounds of force (lbf). In contrast, the STICK A STUD® product was only pulled a distance of approximately 0.08 inches before it failed at a load of 11.6 lbf. These test results show that the applicant's product exhibits 62% higher strength than the STICK A STUD® product.

The test results also highlight differences between the designs of the two products. In the applicant's product, the point of failure was between the adhesive 36 and the mounting surface 110. In the STICK A STUD® product, the point of failure was between the post of the flexible mounting member and the aperture defined in the fastener. A point of failure between the adhesive 36 and the mounting surface 110 (as in the applicant's product) is preferred such that no part of the assembly 10 is left behind on the mounting surface 110. For example, because the STICK A STUD® product failed between the flexible mounting member and the fastener, the flexible mounting member was left secured to the mounting surface. Leaving components secured to the mounting surface is undesirable because those components must be removed, which may be difficult.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

The invention claimed is:

1. A male assembly for a fastener, the male assembly comprising:

a stud comprising at least one protrusion defined by a hollow sidewall having an approximately U-shaped cross-section, and at least one approximately U-shaped pocket defined by an interior surface of the hollow sidewall such that the pocket is inside the protrusion; and a flexible base bonded to the stud, the flexible base comprising at least one extension that substantially fills and bonds to the at least one pocket of the stud, wherein the flexible base is flexible and capable of conforming to a non-planar mounting surface and wherein the flexible base further comprises a layer of adhesive, and wherein the at least one protrusion is a ring-shaped protrusion that extends continuously around the stud.

2. The male assembly as in claim 1, wherein the at least one extension is a ring-shaped extension that extends continuously around the flexible base.

3. The male assembly as in claim 1, wherein the stud is formed of one of metal, rigid plastic, or semi-rigid plastic and the flexible base is comprised of a material including at least one of silicone or rubber.

4. The male assembly as in claim 1, wherein the layer of adhesive is affixed to the flexible base for securing the male assembly to the mounting surface.

5. The male assembly as in claim 1, wherein the male assembly withstands a load of up to approximately 31 lbf prior to failure.

6. The male assembly as in claim 1, wherein a central surface is positioned in a middle of the ring-shaped protrusion and is recessed from the ring-shaped protrusion.

7. The male assembly as in claim 6, wherein a recess is defined by the central surface and an inner surface of the ring-shaped protrusion.

8. A fastener comprising:

a male assembly comprising a stud and a mounting member bonded to the stud, the stud comprising at least one protrusion defined by a hollow sidewall at least one pocket defined by an inner surface of the hollow sidewall, wherein a portion of the mounting member substantially fills and bonds to the at least one pocket of the stud; and wherein the at least one protrusion is a ring-shaped protrusion that extends continuously around the stud, a female assembly comprising a socket and a mounting member bonded to the socket, the socket comprising a receiving portion to receive the protrusion of the stud and thereby engage the female assembly to the male assembly, a base portion, and a corner defined between the base portion and the receiving portion, wherein the mounting member of the female assembly contacts the base portion, the corner, and at least a portion of the receiving portion, wherein the mounting member of the male assembly is flexible and capable of conforming to a non-planar mounting surface, and wherein the hollow sidewall has an approximately U-shaped cross-section and defines the at least one pocket inside the U-shaped cross-section, and wherein the mounting member of the female assembly is flexible and capable of conforming to a non-planar mounting surface.

9. The fastener as in claim 8, wherein the male assembly withstands a load of up to approximately 31 lbf prior to failure.

10. The fastener as in claim 8, wherein the stud of the male assembly is formed of one of metal, rigid plastic, or semi-rigid plastic and the mounting member of the male assembly is comprised of a material including at least one of silicone or rubber.

11. The fastener as in claim 8, further comprising a layer of adhesive affixed to at least one of the mounting member of the male assembly or the mounting member of the female assembly.

12. A fastener comprising:

a male assembly comprising a stud and a mounting member bonded to the stud, the stud comprising at least one protrusion defined by a hollow sidewall at least one pocket defined by an inner surface of the hollow sidewall, wherein a portion of the mounting member substantially fills and bonds to the at least one pocket of the stud; and wherein the at least one protrusion is a ring-shaped protrusion that extends continuously around the stud, a female assembly comprising a socket and a mounting member bonded to the socket, the socket comprising a receiving portion to receive the protrusion of the stud and thereby engage the female assembly to the male assembly, a base portion, and a corner defined between the base portion and the receiving portion, wherein the mounting member of the female assembly contacts the base portion, the corner, and at least a portion of the receiving portion, wherein the mounting member of the male assembly is flexible and capable of conforming to a non-planar mounting surface, and wherein the hollow sidewall has an approximately U-shaped cross-section and defines the at least one pocket inside the U-shaped cross-section, wherein the receiving portion is larger than the base portion so as to extend from the base portion and is defined by a sidewall, and wherein the corner is formed at a position where the base portion and the receiving portion meet so that the mounting member contacts the base portion, the corner, and at least the portion of the receiving portion.

* * * * *